US005155374A

United States Patent [19]

Shirata et al.

[11] Patent Number: 5,155,374

[45] Date of Patent: * Oct. 13, 1992

[54] DRIVING APPARATUS FOR STARTING AN ENGINE WITH STARTER MOTOR ENERGIZED BY A CAPACITOR

[75] Inventors: Akihiro Shirata, Yokohama; Yoshinobu Tsuchiya, Fujisawa; Ken Kurabayashi, Chigasaki, all of Japan

[73] Assignee: Isuzu Motors Limited, Tokyo, Japan

[ * ] Notice: The portion of the term of this patent subsequent to Sep. 8, 2009 has been disclaimed.

[21] Appl. No.: 500,506

[22] Filed: Mar. 28, 1990

[30] Foreign Application Priority Data

Mar. 31, 1989 [JP] Japan ..... 1-82508

[51] Int. Cl.[5] ..... F02N 11/00

[52] U.S. Cl. ..... 290/38 R; 123/179 G

[58] Field of Search ..... 123/179 G; 290/38

[56] References Cited

U.S. PATENT DOCUMENTS 4,467,748 8/1989 Watanabe ..... 123/179 G

OTHER PUBLICATIONS

J. Kaiser, "Electrical Power, Motors, Controls, Generators, Transformers" (1982), pp. 145–165.

A. E. Fitzgerald et al. "Electric Machinery" (5th Ed. 1990) pp. 488–497.

*Primary Examiner*—A. D. Pellinen

*Assistant Examiner*—Lawrence E. Colbert

*Attorney, Agent, or Firm*—Staas & Halsey

[57] ABSTRACT

An engine starter system includes a switching-over circuit arrangement for selectively connecting a large-capacity capacitor parallel or in series to a battery. Normally, the capacitor is connected parallel to the battery and charged thereby. When starting an engine with a starter, the charged capacitor is connected in series to the battery, and the voltage of the capacitor and the voltage of the battery are added and applied to the starter to energize a starter motor for starting the engine.

4 Claims, 2 Drawing Sheets

DRIVING APPARATUS FOR STARTING AN ENGINE WITH STARTER MOTOR ENERGIZED BY A CAPACITOR

BACKGROUND OF THE INVENTION

The present invention relates to an engine starter system for supplying an electric current to the starter mechanism for an engine to start the engine Engines mounted on motor vehicles are usually started by a starter mechanism which comprises a series motor and a magnet switch. Electric power is supplied from a power supply to the starter mechanism to energize the motor to rotate the crankshaft of the engine, thereby starting the engine. If a battery of +12 V, for example, is mounted as the power supply on the motor vehicle, then a large current of 100 A or greater is supplied from the battery to the starter mechanism at the time the engine is started.

There was an attempt to employ loads or accessories on motor vehicles with a unified voltage specification of 12 V while employing a starter circuit with a voltage rating of 24 V for reducing a large current required when starting an engine, to half. Motor vehicles with such a 24 V starter circuit and 12 V accessory circuits required a plurality of 12 V batteries to be used in combination. These combined 12 V batteries could not be charged and discharged in a balanced condition, and required a more troublesome maintenance process and had a shorter service life than a single 12 V or 24 V battery. While the motor vehicles had certain merits such as lower wiring and relay requirements because of the reduced starting current needed, they are not available in the market today owing to the limited battery maintenance and service life.

When the engine on a motor vehicle is started, the starter mechanism consumes a very large current and the battery voltage drops temporarily. Therefore, sufficient electric power cannot be supplied to accessories such as a car radio, a tranceiver, etc., for a few seconds while the starter mechanism is in operation. One solution to this problem is proposed in Japanese Laid-Open Utility Model Publication No. 56(1981)-1466644. The proposed system comprises a series-connected circuit of an engine starter and a starter switch and another series-connected circuit of a unidirectional element and a large-capacity capacitor. These series-connected circuits are connected parallel to the battery. The opposite terminals of the capacitor are connected to accessories on the motor vehicle for supplying electric power from the capacitor to the accessories. The capacitor serves as a power supply for the accessories and is effective to prevent an accessory shutdown at the time of starting the engine. However, when the engine is started, the capacitor is disconnected from the starter circuit by a diode, and hence is not designed for use as a power supply for the starter mechanism.

SUMMARY OF THE INVENTION

It is an object of the present invention to provide an engine starter system which requires a reduced current to be supplied to an engine starter mechanism, so that wiring and relay size requirements are lowered.

Another object of the present invention is to pro vide an engine starter system which reduces loads on a battery to allow the battery to have a longer service life.

According to the present invention, there is provided an engine starter system comprising a battery, a starter for starting an engine with electric power from the battery, a large-capacity capacitor interconnecting the battery and the starter, swtiching-over means for selectively connecting the capacitor parallel or in series to the battery, and control means for controlling the switching-over means to normally connect the capacitor parallel to the battery and to connect the capacitor in series to the battery when starting the engine with the starter.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
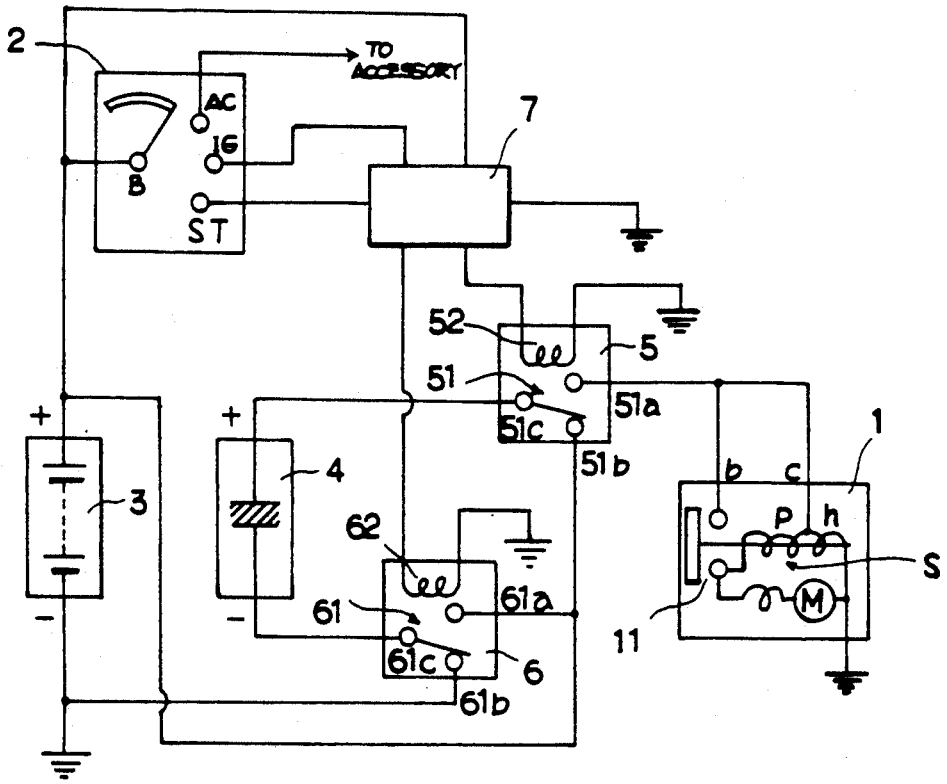
FIG. 1 is a circuit diagram, partly in block form, of an engine starter system according to the present invention.

FIG. 1 shows an engine starter system according to the present invention.

The engine starter system includes an engine starter 1 of a 24 V rating which comprises a known series motor M and a magnet switch S having a pull-in coil p and a holding coil h. When these coils p, h are energized through a terminal c, they magnetically attract a movable contact of the magnet switch S to close a main contact 11 thereof. Then, an electric current is supplied through a terminal b to the motor M, which is energized to rotate the crankshaft of an engine (not shown) on a motor vehicle, thereby starting the engine.

A keyswitch 2 supplies electric power from a 12 V battery 3 to various parts of the motor vehicle. The keyswitch 2 has a switch contact B which is selectively movable to an AC position for supplying the electric power to accessories such as a radio, a car stereo set, etc., an IG position for energizing the ignition unit of the engine, and an ST position for starting the engine. The battery 3 is an ordinary lead battery which is charged and discharged through a chemical reaction between electrodes of lead and its oxide and an electrolytic solution of dilute sulfuric acid.

A large-capacity capacitor 4, which is typically an electric double layer capacitor used as a backup power supply for a memory in an electronic device, has an electrostatic capacitance of 100 F (farad), selectively connected parallel to the battery 3 so that the capacitor 4 can be charged by the battery 3, or connected series to the battery 3 so that the charged electric power is added to the current from the battery 3 to energize the starter 1, by two relays 5, 6 which are connected respectively to the positive and negative terminals of the capacitor 4.

The relay 5 connected to the positive terminal of the capacitor 4 has a single-pole double-throw contact assembly 51 and a drive coil 52 for actuating the contact assembly 51. The contact assembly 51 includes a common contact 51*c* connected to the positive terminal of the capacitor 4, a normally open contact 51*a* connected to the terminals b, c of the starter 1, and a normally closed contact 51*b* connected to the positive terminal of the battery 3. The relay 6 connected to the negative terminal of the capacitor 4 has a single-pole double-throw contact assembly 61 and a drive coil 62 for actuating the contact assembly 61. The contact assembly 61 includes a common contact 61*c* connected to the negative terminal of the capacitor 4, a normally open contact 61*a* connected to the positive terminal of the battery 3, and a normally closed contact 61*b* connected to the negative terminal of the battery 3. Therefore, the capacitor 4 is selectively connected parallel or in series to the battery 3 by switching-over of the relays 5, 6. Energization of the drive coils 52, 62 is controlled to effect the relay switching-over by control currents supplied from a relay control circuit 7, which serves as a switching-over control means.

Figure 2:
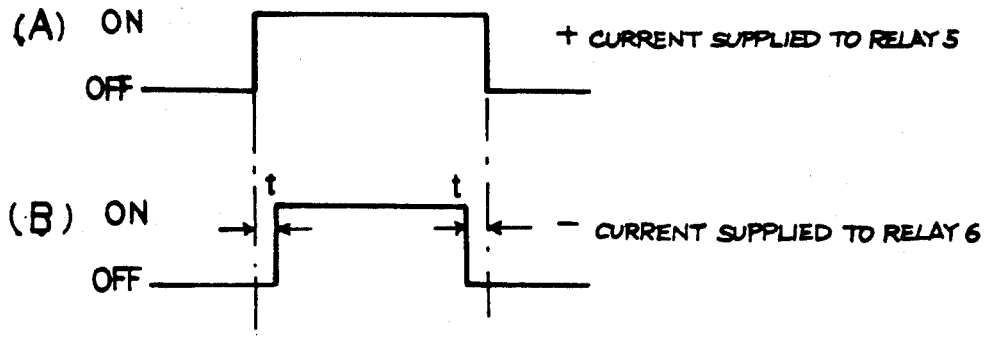
FIG. 2 is a diagram showing the waveforms of currents for controlling relays which are employed in the engine starter system according to the present invention.

FIG. 2 shows the waveform of a current for controlling the relay 5 at (A), and the waveform of a current for controlling the relay 6 at (B).

The IG and ST positions of the keyswitch 2 are connected to input terminals of the relay control circuit 7. When the switch contact B of the keyswitch 2 is shifted to the IG position, no control currents are supplied from the relay control circuit 7 to the relays 5, 6. When the switch contact B is shifted to the ST position, the control currents shown in FIG. 2 are supplied from the relay control circuit 7 to the respective relays 5. 6.

The control current shown in FIG. 2 at (B) has a positive-going edge which is delayed by a delay time t from the positive-going edge of the control current shown in FIG. 2 at (A), and the control current shown in in FIG. 2 at (A) has a negative-going edge which is delayed by the delay time t from the negative-going edge of the control current shown in FIG. 2 at (B). These delay times t are included in order to prevent the capacitor 4 from being shorted out when the relays 5, 6 are switched over.

Operation of the engine starter system will be described below.

In FIG. 1, the capacitor 4 is connected parallel to the battery 3 through the contact assemblies 51, 61 of the relays 5, 6 until the keyswitch 2 is turned to the ST position. Therefore, the voltage across the capacitor 4 is the same as the voltage across the battery 3, i.e., 12 V, and the capacitor 4 is sufficiently charged.

When the keyswitch 2 is turned to the ST position, the relay control circuit 7 supplies the control current shown in FIG. 2 at (A) to the relay 5, and also supplies the control current shown in FIG. 2 at (B) to the relay 6. The drive coils 52, 62 of the relays 5, 6 are energized to switch over the contact assemblies 51, 61, thereby connecting the capacitor 4 in series to the battery 3. Now, the voltage across the capacitor 4 and the voltage across the battery 3 are added to each other, and a voltage of 24 V is applied to the terminals b, c of the starter 1.

The pull-in coil p and the holding coil h are energized to close the main contact 11, whereupon a large current is supplied through the terminal b to the motor M for thereby starting the engine.

After the engine has started, the keyswitch 2 is turned back to the IG position. The control currents are no longer supplied from the relay control circuit 7 to the relays 5, 6. Therefore, the capacitor 4 is again connected parallel to the battery 3 by the contact assemblies 51, 61, and starts to be charged again by the battery 3.

Since the delay times t are included in the waveforms of the control currents for the relays 5, 6 as shown in FIG. 2, the capacitor 4 are prevented from being shorted out at the time the relays 5, 6 are switched over. As a consequence, the relay contacts and wires are prevented from being burned out.

Figure 3:
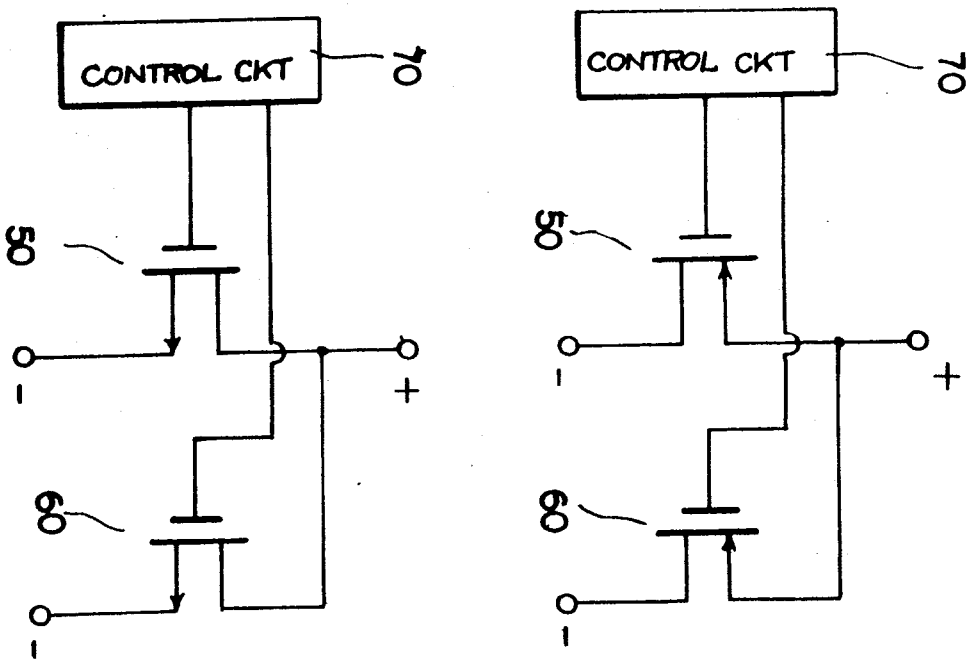
FIG. 3 is a circuit diagram showing relay circuits according to other embodiments of the present invention.

FIG. 3 shows relay circuits according to other embodiments of the invention, the relay circuits comprising semiconductors instead of electromagnetic relays. The relay circuits shown in FIG. 3 may be employed in place of the electromagnetic relays 5, 6 shown in FIG. 1. The semiconductors, denoted at 50 and 60, comprise N-channel or P-channel power FETs (field effect transistors) whose gates are supplied with control signals from a control circuit 70 to make or break the circuit.

With the present invention, the large-capacity capacitor of the electric double layer type is selectively connected parallel or in series to the battery by the relays. Normally, the capacitor is connected parallel to the battery and is charged thereby. When the engine is to be started, the capacitor is connected in series to the battery, and the voltage of the capacitor and the voltage of the battery are added and applied to the starter to energize the motor thereof. Since only one battery is used, its maintenance is easy. The current which is required to be supplied from the battery when starting the engine is half the current which would otherwise be required for the battery to directly start the engine. Therefore, the service life of the battery is increased, and the wiring arrangement and the relays may be smaller in size.

The relays for selectively connecting the large-capacity capacitor parallel or in series to the battery are controlled by differently timed control currents such that one of the relays starts to be energized earlier than the other relay and the other relay starts to be de-energized earlier than said one relay. Therefore, the capacitor is prevented from being shorted out and hence the relay contacts and wires are prevented from being burned out when the relays are switched over.

Although certain preferred embodiments have been shown and described, it should be understood that many changes and modifications may be made therein without departing from the scope of the appended claims.

What is claimed is:

1. A driving apparatus supplying electric power from a battery to a starter motor coupled to a crankshaft of an engine mounted on a motor vehicle for driving the starter motor, and starting the engine with the starter motor, said driving apparatus comprising:

a battery;

a starter for starting an engine with electric power from said battery;

a large-capacity capacitor interconnecting said battery and said starter;

switching-over means for selectively connecting said capacitor in parallel or in series to said battery; and control means for controlling said switching-over means to normally connect said capacitor in parallel to said battery and to connect said capacitor in series to said battery when starting the engine with said starter.

2. A driving apparatus according to claim 1, wherein said capacitor comprises an electric double layer capacitor.

3. A driving apparatus according to claim 1, wherein said switching-over means comprises:

a first relay for normally connecting a positive terminal of said capacitor to a positive terminal of said battery and for connecting the positive terminal of said capacitor to said starter when starting the engine with said starter; and a second relay for normally connecting a negative terminal of said capacitor to a negative terminal of said battery and for connecting the negative terminal of said capacitor to he positive terminal of said battery.

4. A driving apparatus according to claim 3, wherein said control means comprises means for starting to energize said first relay earlier than said second relay and starting to de-energize said second relay earlier than said first relay when starting the engine with said starter.

* * * * *